United States Patent [19]

Pound et al.

[11] 4,218,580

[45] Aug. 19, 1980

[54] PAPER PULP INSULATED CABLE AND METHOD OF MANUFACTURE

[75] Inventors: Thomas C. Pound, Kingston; Eric J. Gouldson, Shawbridge, both of Canada

[73] Assignee: Northern Telecom Limited, Montreal, Canada

[21] Appl. No.: 911,135

[22] Filed: May 31, 1978

Related U.S. Application Data

[62] Division of Ser. No. 672,366, Mar. 31, 1976, Pat. No. 4,113,534.

[51] Int. Cl.[2] ..... H01B 7/28; H01B 3/52; H01B 11/02

[52] U.S. Cl. ..... 174/107; 174/27; 174/110 P; 174/113 R

[58] Field of Search ..... 174/27, 34, 110 P, 122 R, 174/119 C, 124 R, 113 R; 427/117, 120, 121, 180, 394, 395, 396, 397; 428/393

[56] References Cited

U.S. PATENT DOCUMENTS

| | | | |
|---|---|---|---|
| 1,615,418 | 1/1927 | Walker et al. | 174/124 R X |
| 2;051,423 | 8/1936 | Schacht | 174/124 R X |
| 2,379,756 | 7/1945 | Selvig | 174/124 R X |
| 2,687,677 | 8/1954 | Krogel | 162/106 |
| 3,059,046 | 10/1962 | Westervelt et al. | 174/119 X |
| 3,662,091 | 5/1972 | Jachimowicz et al. | 174/110 P |
| 3,903,352 | 9/1975 | Suter et al. | 174/110 P X |
| 3,917,901 | 11/1975 | Jones | 174/110 P |
| 4,125,645 | 11/1978 | Jukes et al. | 174/124 R X |

*Primary Examiner*—Arthur T. Grimley
*Attorney, Agent, or Firm*—Sidney T. Jelly

[57] ABSTRACT

A paper pulp insulated cable of the kind having a plurality of conductors covered with paper pulp insulation. The insulated conductors are twisted into pairs, the pairs are stranded into units and the units are built up into cores, covered with, for example, a paper wrap, aluminum, steel sheath and a polyethylene jacket. The cable has a high density of conductors. Also a method of manufacturing such cables is described.

21 Claims, 3 Drawing Figures

PAPER PULP INSULATED CABLE AND METHOD OF MANUFACTURE

This is a divisional of application Ser. No. 672,366 filed Mar. 31, 1976 (granted as U.S. Pat. No. 4,113,534.

The present invention relates to electrical cables and particularly to paper pulp insulated cables, and methods of their manufacture.

Paper pulp insulated cables typically contain from a few tens of pairs of conductors to a few thousand pairs of conductors. A conductor is covered with paper pulp insulation, and two insulated conductors are twisted into a pair. The pairs are then grouped into a unit, typically 100 pairs per unit, which are then built up into cores containing typically from 300 to 3,600 pairs. The cores are then sheathed, for example, with a paper wrap and an overlay of aluminum, then steel, a flooding compound, and an outer low density polyethylene jacket. Such cables are well known and have been commercially available for approximately 50 years.

In certain applications, where large cables are used, it is important that the outside diameter of the cables be as small as possible. An example might be helpful. A typical prior art 3,600 pair cable of 26 AWG copper conductor had an outside diameter of 3.31 inches and a 3,000 pair cable was 2.99 inches. In certain installations e.g. in the center of large cities, telephone cables are located in underground ducts which are buried beneath the street. At the approaches to the central office the density of underground cable (which are in ducts) is very high. Furthermore, in some cities there is very little space for new ducts and for the installation of new cable. Certain utilities, which have priority over telephone cables, take the upper portion of the space available beneath the street. Sewer lines must have a certain slope and therefore take first priority; water mains, fire hydrants, subways, pneumatic distribution systems, steam lines and power distribution lines all tend to get the upper or closest to the street priority. The result is that telephone cables are placed beneath the other utility spaces and in certain instances have extended 100 feet below the surface. When it is necessary to add telephone cables it is very difficult and expensive or impossible to curve space for the new ducts below the existing ones. An additional constraint is the size of the duct which limits the diameter of the cable that can be installed therein.

In accordance with the present invention, a paper pulp insulated cable comprises a plurality of conductors each surrounded by a paper pulp insulation. Pairs of these conductors are twisted together and groups of pairs are then stranded together to form a cable core. An outer sheath and jacket surround the core. The conductors of the present invention exhibit a capacitance of:

$$C = \frac{0.194\ \epsilon\ ins}{\mathrm{Log}_{10}\left(\frac{2s}{d}\right) - 0.14}$$

where:

C=mutual capacitance=0.083 microfarads/mile, $\epsilon_{ins}$=dielectric constant of the paper pulp insulation, =1.47 to 1.69, s=diameter of the insulated conductor, d=diameter of the conductor, and 2s/d=3.2 to 3.4.

Thus cables with high pair density become in great demand in certain new installations or to replace existing low density types. New cables with fifteen percent more conductor pairs, and the same outside diameter, at times make it commercially expedient to pull out from the ducts the old cables, and replace them with the new high density cables. By way of an example a high density cable having the same gauge wire and electrical characteristics as old cable for 3,600 pairs has an outside diameter of 3.08±0.02 inches instead of 3.31, and a 3,000 pair cable has 2.90±0.02 inches instead of 2.99.

Although the new cable has been initially used where space is at a premium, it is thought the cable may have general application wherever paper pulp insulated cable is needed.

Figure 1:
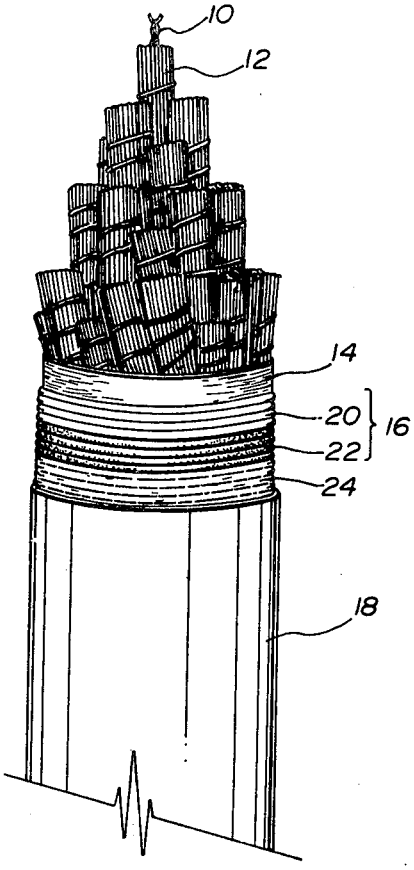
FIG. 1 is a plan view of a paper pulp insulated cable cut away in part to expose its constituents.

Referring now to FIG. 1 there is shown two insulated conductors twisted into a pair 10. The pairs are stranded and bound into units 12, typically 100 pairs per unit. The units are built up or cabled into cores containing typically from 300 to 3,600 pairs.

The core is then wrapped with a paper tape 14, which is then sheathed, i.e. placed in metal sheath 16, and then protected with a plastic or rubber jacket 18. The sheathing typically is 8 mil (1 mil=1/1,000 inch) aluminum 20 and 6.1 mil tin-plate steel 22 transversely corrugated. The steel may be soldered at its seam. A flooding compound 24 is applied over the steel to prevent corrosion of the steel, over which is applied the plastic jacket 18 which for example is low density polyethylene.

A typical cable with 26 AWG, solid annealed copper conductor, 102% conductivity (Matthiessen's Standard) would have the following electrical characteristics:

| | | |
|---|---|---|
| Conductor Resistance at 20° C. (ohms/loop mile) | | |
| Nominal - 172 | Maximum - 186 | |
| Inductance at 1000 Herz (Hertz/mile) | | |
| Nominal - 0.001 | | |
| Insulation Resistance at 15.5° C. (megohm miles) | | |
| Minimum - 1000 | | |
| Average Mutual Capacitance at 900 Hertz at 15.5° C. (microfarads /mile) | | |
| Nominal - 0.083 | Maximum - 0.090 | |
| Dielectric Strength (volts RMS) | | |
| Conductor-to-conductor | | 350 |
| Conductor-to-shield | | 1000 |
| Nominal Characteristic Impedance at 1000 Hertz | | |
| Non-loaded | | |
| Resistance (ohms) | | 576 |
| Negative angle (degrees) | | 44 |
| H-88 loading | | |
| Resistance (ohms) | | 1051 |
| Negative angle (Degrees) | | 10 |
| Conductance at 900 Hertz at 15.5° (micromhos/mile) | | |
| Nominal 2.25 | | |
| Nominal attenuation at 100 Hertz at 20° C. (decibels/mile) | | |
| Non-loaded - 1.75 | H-88 loading - 0.79 | |

The important electrical characteristics is the mutual capacitance: 0.083 microfarad per mile. This is an industry standard for telephone use.

Figure 2:
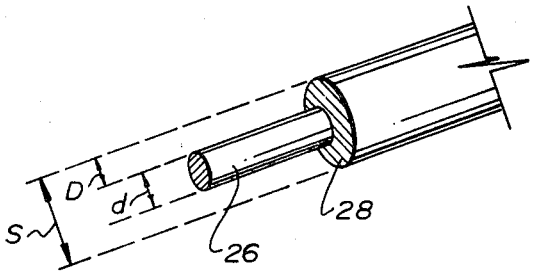
FIG. 2 is a perspective view of a single conductor with paper pulp insulation of the kind in the cable of FIG. 1.

Referring now to FIG. 2, there is shown a single conductor 26 having a diameter d, with paper pulp insulation 28 partially cut away and having an outside diameter s. For 26 AWG copper conductor, the paper pulp insulation has a density of approximately 0.42 grams/cm$^3$, and a wall thickness D of approximately 5 mil. A satisfactory measured range of density is 0.44 to 0.40 grams/cm$^3$. Density is measured on dry insulation. The measurement is taken after the insulation has remained in an oven at 105° C. for 10 to 15 minutes.

For 28 AWG copper conductor, the insulation density is approximately 0.44±0.02 grams/cm$^3$, and a wall thickness of 4 mil.

For 24 AWG copper conductor, the insulation density is approximately 0.39±0.03 grams/cm$^3$, and a wall thickness of 7 mil.

For 22 AWG copper conductor, the insulation density is approximately 0.39±0.03 grams/cm$^3$, and a wall thickness of 8.6 mil.

For 19 AWG copper conductor, the insulation density is approximately 0.37±0.04 grams/cm$^3$, and a wall thickness of 10.2 mil.

Figure 3:
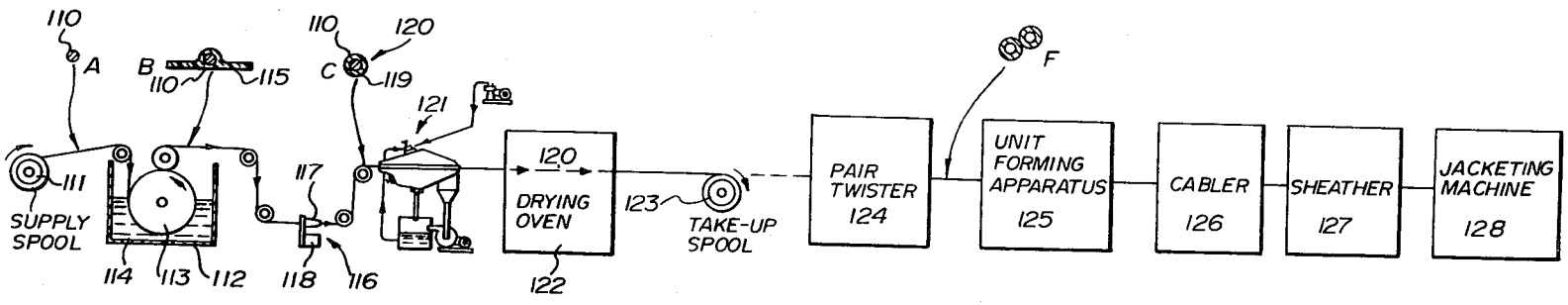
FIG. 3 is a schematic diagram illustrating the different stages in forming paper pulp insulated cable.

Referring now to FIG. 3, there is schematically shown a continuous strand of copper wire conductor 110, shown in cross section at A being unwound from a supply spool 111 into a pulp vat 112 where it passes around a cylinder mold 113 partially submerged in a paper pulp liquid or slurry 114. Conductor 110 emerges from vat 112 imbedded in a strip coating 115 of paper pulp as shown in cross section B. Coated wire 110 next passes through a polisher 116 between elements or shoes 117 axially rotated by a motor 118 which folds lateral portions of strip coating 115 around the wire to form an annular sheath or layer of insulation 119 producing an insulated conductor 120 as shown in cross section C. From polisher 116 the insulated conductor 120 may pass through a color coding machine 121 which colors the insulation. Upon emergence therefrom, the insulated conductor 120 passes into a drying oven 122 where the moisture carried by insulation 119 from pulp vat 112 and color coding machine 121 is evaporated resulting in a insulated conductor which is then wound on a take up spool 123. Two insulated conductors are then fed into a twisting apparatus 124 which forms them into pairs as shown in cross section at F. A plurality of pairs are fed to a unit forming apparatus 125 which strands and binds the twisted pairs into a unit of typically 110 pairs per unit. A unit is shown in FIG. 1 with legend 12. The units are fed to a cabler 126 where the units are grouped and then sheathed.

On the cabler 126 the units may be rotated around one another into cores (for example in a 36 inch lay). The cores are then wrapped with paper tape, after which they are sheathed in a sheather 127 typically with a Stalpeth (Registered Trademark) sheathing (aluminum, steel, and polyethylene). Over the core wrap paper 14, an 8 mil aluminum 20 (FIG. 1) and 6.1 mil tin plate steel 22 transversely corrugated are formed longitudinally around the core. In a jacketing machine 128, a flooding compound 24 (e.g. asphalt rubber) is applied over the steel after which polyethylene is extruded over the compound.

The steps may be performed in batches. Drying may be required of the paper pulp and paper wrap to ensure proper dryness. For those unfamiliar with the general process or wishing more detail, reference is made to "The Western Electric Engineer" vol. XV. No. 3 (1971) pages 86–97.

The paper pulp slurry typically has kraft soft wood pulp fibers with an average length of 2.5 mm. A satisfactory distribution from average is 30% of the fibers (dry weight) do not pass a No. 10 mesh (3.75 mm); 27% a No. 14 mesh (3.05 mm); 21% a No. 28 mesh (2.00 mm); 10% a No. 48 mesh (1.23 mm); and 11% pass the No. 48 mesh.

The pulp is disintegrated and refined, and has a Freeness Value of 480 milliliters Canadian Standard Freeness (Standard D 3396—ASTM Pulp Test Series).

The amount of paper pulp or strip coating 115 applied to the conductor 110 is 0.0286 grams/foot (dry weight) for 26 AWG copper with a typical variation of ±0.0004 gram/foot; is 0.0194 gram/foot for 28 AWG copper; 0.0491 gram/foot for 24 AWG copper; 0.0697 gram/foot for 22 AWG copper; and 0.1080 gram/foot for 19 AWG copper, all measures with a permissible variation of ±2%.

The drying oven 122 is 26 feet long and has three adjacent equal length furnaces with heating sources four feet long through which the insulated conductor 120 sequentially pass at temperatures of 1600° F.; 1150° F.; 875° F. at a typical speed of 200 feet per minute for 26 AWG copper; 1500° F.; 1150° F.; 650° F. at a speed of 200 feet/minute for 28 AWG copper; 1600° F.; 1300° F.; 1000° F. at a speed of 200 feet/minute for 24 AWG copper; 1600° F.; 1400° F.; 1100° F. at a speed of 180 feet/minute for 22 AWG copper; and 1600° F.; 1300° F.; 900° F. at a speed of 150 feet/minute for 19 AWG copper. After drying the insulation should have a water content of between 3–8% for 28 AWG, 26 AWG and 24 AWG copper, and between 4–10% for 22 AWG and 19 AWG copper.

The drying step in addition to removing water from the paper pulp insulation also "fluffs" the insulation, so that it has a density of 0.42±0.02 grams/cm$^3$ (dry weight) for 26 AWG copper; approximately 0.44 grams/cm$^3$ for 28 AAWG copper; approximately 0.39 grams/cm$^3$ for 24 AWG copper; approximately 0.39 grams/cm$^3$ for 22 AWG copper and approximately 0.37 grams/cm$^3$ for 19 AWG copper.

The temperature may be adjusted to provide the proper density. For example the first stage furnace may be varied by ±100° F. to provide proper "fluffiness" or density. Alternatively the duration of applied heat, the speed of travel through, or length of, each furnace may be varied. The second and last stage furnaces are adjusted primarily to control the amount of drying of paper pulp insulation.

The amount of paper pulp applied from the vat 112 onto the conductor 110 may be adjusted so that there is a sufficient mass of insulation (of proper density) on the conductor. This may be done by adjusting the amount of paper pulp in the strip coating 115, e.g. by varying the slurry concentration, etc. It has been found that the cable may be made with a slightly different amount of refining i.e. with a Canadian Standard Freeness of 600 milliliters.

It has been found that a pair of insulated conductors in a completed cable has a mutual capacitance which satisfies the following equation.

$$C = \frac{0.194\ \epsilon\ \text{ins}}{\text{Log}_{10}\left(\frac{2s}{d}\right) - 0.14}$$

where:

C=the mutual capacitance=0.083 mF/miel $\epsilon ins$=dielectric constant of the paper pulp insulation
s=diameter of the insulated conductor
d=diameter of the bare conductor.

Typical values for the various gauges described in this specification can be obtained from the following table.

| | 28 AWG | 26 AWG | 24 AWG | 22 AWG | 19 AWG |
|---|---|---|---|---|---|
| C | .083 | .083 | .083 | .083 | .083 |
| $\epsilon_{ins}$ (min) | 1.62 | 1.58 | 1.52 | 1.52 | 1.47 |
| $\epsilon_{ins}$ (max) | 1.69 | 1.65 | 1.62 | 1.62 | 1.60 |
| $\frac{2s}{d}$ | 3.4 | 3.3 | 3.3 | 3.3 | 3.2 |

It has further been found that cables made in accordance with this invention yield an increase in the number of pairs for a given cable diameter over conventional cable in the order of 12 to 20%. Typical pair counts for a 3.10 inch diameter cable made in accordance with this invention and in accordance with conventional methods are given in the following table.

| Conductor Size | Number of Pairs in a 3.10 inch O.D. Cable: Cable of the Present Invention | Conventional Cable |
|---|---|---|
| 28 AWG | 5400 | 4800 |
| 26 AWG | 3600 | 3000 |
| 24 AWG | 2100 | 1800 |
| 22 AWG | 1300 | 1100 |
| 19 AWG | 700 | 600 |

I claim:

1. A paper insulated cable comprising a plurality of conductors each surrounded by paper pulp insulation, pairs of said conductors being twisted together, and groups of said pairs being stranded together, and outer sheathing and jacket, said conductors of the pairs exhibiting a capacitance of $$C = \frac{0.194\ \epsilon\ ins}{\mathrm{Log}_{10}\left(\frac{2s}{d}\right) - 0.14}$$

where
C=mutual capacitance=0.083 microfarads/mile
$\epsilon_{ins}$=dielectric constant of the paper pulp insulation =1.47 to 1.69
s=diameter of the insulated conductor
d=diameter of the conductor, and 2s/d=3.2 to 3.4.

2. A cable according to claim 1 wherein the diameter of said conductor is approximately 12.6 mil, the diameter of said insulated conductor is 21.1±0.4 mil, and said dielectric constant is 1.65.

3. A cable according to claim 1 wherein the diameter of said conductor is approximately 15.9 mil, the diameter of said insulated conductor is 26.3±0.4 mil, and said dielectric constant is 1.62.

4. A cable according to claim 1 wherein the diameter of said conductor is approximately 20.1 mil, the diameter of said insulated conductor is 34.0±0.4 mil, and said dielectric constant is 1.56.

5. A cable according to claim 1 wherein the diameter of said conductor is approximately 25.3 mil, the diameter of said insulated conductor is 42.1±0.4 mil, and said dielectric constant is 1.56.

6. A cable according to claim 1 wherein the diameter of said conductor is approximately 35.9 mil, the diameter of said insulated conductor is 56.4±0.4 mil, and said dielectric constant is 1.53.

7. A paper pulp insulated cable comprising at least several hundred copper conductors of 28 AWG, paper pulp insulation surrounding each conductor, said insulated conductors being twisted into pairs, stranded into units, and cabled, a sheath encasing said cabled insulated conductors, and a jacket thereon, said paper pulp insulation having a density of approximately 0.44 grams/cm$^3$, a thickness of approximately 4 mils, and said wires of each pair having a mutual capacitance of approximately 0.083 microfarads/mile.

8. An insulated cable according to claim 7 wherein the paper pulp insulation has a density in the range of 0.42 to 0.46 grams/cm$^3$.

9. A cable according to claim 8 wherein said cable has 5400 pairs, a sheath of aluminum, steel and polyethylene and a maximum outside diameter of 3.10 inches.

10. A paper pulp insulated cable comprising at least several hundred copper conductors of 26 AWG, paper pulp insulation surrounding each conductor, said insulated conductors being twisted into pairs, stranded into units, and cabled, a sheath encasing said cabled insulated conductors, and a jacket thereon, said paper pulp insulation having a density of approximately 0.42 grams/cm$^3$, a thickness of approximately 5 mils, and said wires of each pair having a mutual capacitance of approximately 0.083 microfarads/mile.

11. An insulated cable according to claim 10 wherein the paper pulp insulation has a density in the range of 0.40 to 0.44 grams/cm$^3$.

12. A cable according to claim 11 wherein said cable has 3600 pairs, a sheath of aluminum, steel and polyethylene and a maximum outside diameter of 3.10 inches.

13. A paper pulp insulated cable comprising at least several hundred copper conductors of 24 AWG, paper pulp insulation surrounding each conductor, said insulated conductors being twisted into pairs, stranded into units, and cabled, a sheath encasing said cabled insulated conductors, and a jacket thereon, said paper pulp insulation having a density of approximately 0.39 grams/cm$^3$, a thickness of approximately 7 mils, and said wires of each pair having a mutual capacitance of approximately 0.083 microfarads/mile.

14. An insulated cable according to claim 13 wherein the paper pulp insulation has a density in the range of 0.36 to 0.42 grams/cm$^3$.

15. A cable according to claim 14 wherein said cable has 2100 pairs, a sheath of aluminum, steel and polyethylene and a maximum outside diameter of 3.10 inches.

16. A paper pulp insulated cable comprising at least several hundred copper conductors of 22 AWG, paper pulp insulation surrounding each conductor, said insulated conductors being twisted into pairs, stranded into units, and cabled, a sheath encasing said cabled insulated conductors, and a jacket thereon, said paper pulp insulation having a density of approximately 0.39 grams/cm$^3$, a thickness of approximately 8.6 mils, and said wires of each pair having a mutual capacitance of approximately 0.083 microfarads/mile.

17. An insulated cable according to claim 16 wherein the paper pulp insulation has a density in the range of 0.36 to 0.42 grams/cm$^3$.

18. A cable according to claim 17 wherein said cable has 1300 pairs, a sheath of aluminum, steel and polyethylene and a maximum outside diameter of 3.10 inches.

19. A paper pulp insulated cable comprising at least several hundred copper conductors of 19 AWG, paper pulp insulation surrounding each conductor, said insulated conductors being twisted into pairs, stranded into units, and cabled, a sheath encasing said cabled insulated conductors, and a jacket thereon, said paper pulp insulation having a density of approximately 0.37 grams/cm$^3$, a thickness of approximately 10.2 mils, and said wires of each pair having a mutual capacitance of approximately 0.83 microfarads/mile.

20. An insulated cable according to claim 19 wherein the paper pulp insulation has a density in the range of 0.33 to 0.41 grams/cm$^3$.

21. A cable according to claim 20 wherein said cable has 700 pairs, a sheath of aluminum, steel and polyethylene and a maximum outside diameter of 3.10 inches.

* * * * *